United States Patent [19]

Satomura et al.

[11] Patent Number: 4,847,236

[45] Date of Patent: Jul. 11, 1989

[54] RECORDING MATERIAL

[75] Inventors: Masato Satomura; Ken Iwakura; Akira Igarashi, all of Shizuoka, Japan

[73] Assignee: Fuji Photo Film Co., Ltd., Kanagawa, Japan

[21] Appl. No.: 132,438

[22] Filed: Dec. 14, 1987

[30] Foreign Application Priority Data

Dec. 15, 1986 [JP] Japan ..... 61-298406

[51] Int. Cl.[4] ..... B41M 5/16; B41M 5/18

[52] U.S. Cl. ..... 503/208; 427/150; 428/342; 428/913; 428/914; 503/209; 503/225

[58] Field of Search ..... 427/150–152; 503/208, 209, 225; 428/341, 342, 913, 914

[56] References Cited

U.S. PATENT DOCUMENTS 4,531,140 7/1985 Suzuki et al. ..... 503/208

FOREIGN PATENT DOCUMENTS 0264290 12/1985 Japan ..... 503/208
0215087 9/1986 Japan ..... 503/209
1217285 9/1986 Japan ..... 503/209

*Primary Examiner*—Bruce H. Hess
*Attorney, Agent, or Firm*—Sughrue, Mion, Zinn, Macpeak, and Seas

[57] ABSTRACT

A recording material is described capable of color formation by the contact of a colorless electron donating dye with an electron accepting compound, wherein the recording material contains a compound represented by formula (I) or (II)

$$Ar_1XC_nH_{2n}YC_mH_{2m}ZAr_2 \quad (I)$$

wherein $Ar_1$ and $Ar_2$ each represents an aromatic ring which may contain an oxygen atom or a sulfur atom: Z represents a divalent group selected from the group consisting of —CO— and —O—; X represents a divalent group selected from the group consisting of —O— and —S—, and Y represents a divalent group selected from the group consisting of —O—, —S— and —$CO_2$—, provided that Z is —CO—, or X represents a divalent group of —O— and Y represents a divalent group selected from the group consisting of —$CO_2$—, —$SO_2$— and —SO—, provided that Z is —O—; and n and m each represents an integer of from 1 to 6, $$Ar_1XC_nH_{2n}YC_mH_{2m}YC_nH_{2n}XAr_2 \quad (II)$$

wherein $Ar_1$ and $Ar_2$ each represents an aromatic ring which may contain an oxygen atom or a sulfur atom; X represents a divalent group selected from the group consisting of —S— and —O—; Y represents a divalent group of —$CO_2$—; and n and m each represents an integer of from 1 to 6.

10 Claims, No Drawings

RECORDING MATERIAL

FIELD OF THE INVENTION

The present invention relates to a recording material, and more particularly it relates to a recording material having improved color forming properties and stability of colored images.

BACKGROUND OF THE INVENTION

Pressure-sensitive appear, heat-sensitive paper, light- and pressure-sensitive paper, electric heat-sensitive paper, a heat-sensitive transfer paper, and the like are well known as recording materials using a colorless electron donating dye and an electron accepting compound. They are disclosed in detail, for example, in British Pat. No. 2,140,449, U.S. Pat. Nos. 4,480,052, 4,436,920, 4,539,578, 4,523,205, 4,479,138, 4,531,140 and 4,471,074, Japanese Patent Publication No. 23922/85, Japanese Patent Application (OPI) Nos. 71191/73, 179836/82, 123556/85 and 123557/85 (the term "OPI" used herein means a published unexamined Japanese patent application).

A recording material must have properties such that (1) color densities and color sensitivities should be sufficient, (2) fog formation should not take place at 65° to 70° C., and (3) light-fastness of colored images should be sufficient.

Recently, many efforts have been made to improve the above properties, and extensive research has been done.

The inventors of the present invention have found that certain compounds are effective to improve the above properties.

SUMMARY OF THE INVENTION

An object of the present invention is to provide a recording material having good color forming properties, good stability of colored images, and meeting the requirements for recording materials.

The object of the present invention can be attained by a recording material capable of color formation by contact of a colorless electron donating dye with an electron accepting compound, wherein a compound having a predetermined functional group is contained. The compound of the present invention is a compound represented by formula (I) or (II).

$$Ar_1XC_nH_{2n}YC_mH_{2m}ZAr_2 \quad (I)$$

In the formula (I), $Ar_1$ and $Ar_2$ each represents an aromatic ring which may contain an oxygen atom or a sulfur atom, Z represents a divalent group selected from the group consisting of —CO— and —O—; when Z is —CO—, X represents a divalent group selected from the group consisting of —O— and —S—, and Y represents a divalent group selected from the group consisting of —O—, —S— and —$CO_2$—, or when Z is —O—, X represents a divalent group of —O— and Y represents a divalent group selected from the group consisting of —$CO_2$—, —$SO_2$— and —SO—; and n and m each represents an integer of from 1 to 6.

$$Ar_1XC_nH_{2n}YC_mH_{2m}YC_nH_{2n}XAr_2 \quad (II)$$

In the formula (II), $Ar_1$ and $Ar_2$ each represents an aromatic ring which may contain an oxygen atom or a sulfur atom; X represents a divalent group selected from the group consisting of —S— and —O—; Y represents a divalent group of —$CO_2$—; and n and m each represents an integer of from 1 to 6.

DETAILED DESCRIPTION OF THE INVENTION

Among the compounds represented by formula (I) or (II), those compounds having a melting point of from 70° to 190° C. and contains 16 to 28 carbon atoms are preferred. The two aromatic rings may be substituted with one or more of a halogen atom, a hydroxy group or a group having 8 or less carbon atoms (preferably 4 or less carbon atoms) such as an alkoxy group, and alkylthio group, an alkoxycarbonyl group, an acyloxy group, an acyl group, an alkyl group, an aryl group or cyano group. The above alkyl parts having 8 or less carbon atoms may further be substituted with a substituent (preferably 7 or less carbon atoms) such as an alkoxy group, a halogen, an acyl group, an aryloxy group, an alkoxycarbonyl group, or a cyano group. It is more preferred that the compound has a melting point of from 85° to 130° C. and contains 16 to 26 carbon atoms.

The preferred compounds are those compounds wherein $Ar_1$ or $Ar_2$ represents a benzene ring or a naphthalene ring having halogen atom, hydrogen atom, or a group selected from an alkyl group, an alkoxy group, or an alkylthio group. When X is —O—, Z is —CO—, and Y is —$CO_2$—, it is preferred that n and m each is 1, 2, or 3.

Specific examples of the compounds include β'-phenoxyethyl-γ-p-methoxybenzoylpropionate, β'-p-methoxyphenoxyethyl-γ-methylbenzoylpropionate, β'-phenoxyethyl-γ-naphthoylpropionate, β'-phenoxypropyl-γ-naphthoylpropionate, β'-phenoxyethyl-γ-phenyl-benzoylpropionate, β'-phenoxyethyl-γ-p-phenoxybenzoylpropionate, β'-phenoxypropyl-γ-p-phenylbenzoylpropionate, β'-phenylthioethyl-γ-naphthoylpropionate, β'-phenylsulfonylethyl-γ-naphthoylpropionate, β'-phenylthioethyl-γ-p-phenylbenzoylpropionate, ethyleneglycol dinaphthoxyacetate, bisnaphthoxyethyl sulfone, bisbenzoyloxyethyl sulfone, 1,4-butanediol-di-α-naphthoxy-2-acetate, β'-p-chlorophenoxyethyl-β-naphthoxyacetate, β'-p-methoxyphenoxyethyl-β-naphthoxyacetate, etc.

Colorless electron donating dyes include various well-known compounds such as triphenylmethane phthalide compounds, fluoran compounds, phenothiazine compounds, indolylphthalide compounds, leucoauramine compounds, rhodamine lactam compounds, triphenylmethane compounds, triazene compounds, or spiropyran compounds.

Typical examples of the colorless electron donating dyes include, as a partial listing, triarylmethane compounds such as 3,3-bis(p-dimethylaminophenyl)-6-dimethylaminophthalide (that is, crystal violet lactone), or 3,3-bis(p-dimethylaminophenyl)phthalide, diphenylmethane compounds such as 4,4'-bis-dimethylaminobenzhydrin benzyl ether, N-halophenylleucoauramine, and N-2,4,5-trichlorophenyl-leucoauramine, xanthene compounds such as rhodamine-B-anilinolactam, rhodamine(p-nitroanilino)lactam, rhodamine B(p-chloroanilino)lactam, 2-anilino-6-diethylaminofluoran, 2-anilino-3-methyl-6-diethylaminofluoran, 2-nilino-3-methyl-6-cyclohexylmethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, pyridyl blue, 2-anilino-3-methyl-6-diisobutylaminofluoran, 2-phenyl- 6-diethylaminofluoran, 2-anilino-3-methyl-6-N-ethyl-N-isoamylaminofluoran, · 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethyl-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, 2-o-toluidino-3-methyl-6-diisopropylamino-4'5'-dimethylaminofluoran, 2-anilino-3-ethyl-6-N-ethyl-N-isoamylaminofluoran, 2-anilino-3-methyl-6-N-ethyl-N-γ-piridylpropylaminofluoran or 2-anilino-3-chloro-6-N-ethyl-N-isoamylaminofluoran, thiazine compounds such as benzoylleucomethylene blue or p-nitrobenzoyl leucomethylene blue and spiro compounds such as 3-methyl-spiro-dinaphthopyran, 3-ethyl-spiro-dinaphthopyran, 3,3'-dichloro-spirodinaphthopyran, 3-benzyl-spiro-dianphthopyran, 3-mehtylnaphtho-(3-methoxybenz)spiropyran or 3-propyl-spirodibenzopyran, which are preferably used in combination.

The electron accepting compounds which cause color formation when brought into contact with colorless dyes include inorganic and organic Lewis acids and Brönsted acids. Specific examples of the electron accepting compounds include phenol derivatives, salicylic acid derivatives, metal salts of aromatic carboxylic acid, acid clay, bentonite, novolac resins, and metal treated novolac resins. Typical examples of the organic developers include phenol derivatives such as 2-chloro-4-phenylphenol, 2,2-bis(4-hydroxyphenyl)propane, 4,4-isopropylidenebis(2-methylphenol), 1,1-bis(3-chloro-4-hydroxyphenyl)cyclohexane, 2,2-bis(3-chloro-4-hydroxyphenyl)-3-methylbutane, 4,4'-secondary-isooctylydenediphenol, 4,4'-sec-butylydenephenol, 4-cyanophenylphenol, 4,4'-isopentylydenediphenol, 4,4'-methylcyclohexylydenediphenol, 1,4-bis-4'-hydroxycumylbenzene, 1,4-bis-4'-hydroxybenzoylbenzene, 4,4'-thiobis(3,6-dimethyl phenol), 4,4'-dihydroxydiphenylsulfone, phloroglucinemonobenzylether, 4-hydroxybenzophenone, 2,4-dihydroxy 4'-butoxybenzophenone, 3,3'-methylenebis-4-hydroxybenzoic acid benzyl ester, polyvinylphenol or 2,2',4,4'-tetrahydroxydiphenylsulfone, aromatic carboxylic acids, such as dimethyl 4-hydroxyphthalate, isobutyl 4-hydroxybenzoate, 2,4,4'-trihydroxy 2'-benzyloxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, m-xylylenebis 4-hydroxybenzoate, phenethyl 4-hydroxybenzoate, p-cumylbenzyl 4-hydroxybenzoate, cinnamyl 4-hydroxybenzoate, benzyl 4-hydroxybenzoate, m-chlorobenzyl 4-hydroxybenzoate, cumyl 4-hydroxybenzoate, 4,4'-hydroxy-2',2'-dibutylphenylsulfone, β-phenethylorsellinate, cinnamyl orsellinate, o-chlorophenoxyethyl orssellinate, 5,5'-methylenebis-2,4-dihydroxybenzoic acid benzyl ester, o-phenylphenoxyethyl orsellinate, m-phenylphenoxy ethyl orsellinate, β-3'-t-butyl-4'-hydroxyphenoxyethyl 2,4-dihydroxybenzoate, bisphenol A bis-p-hydroxybenzoate, 5-β-p-methoxyphenoxyethoxy-2-hydroxybenzoic acid, 2,4-dihydroxybenzoic acid, p-methylbenzyl ether, β-phenoxyethyl, 2,4-dihydroxybenzoate, o-methyl benzyl 2,4-dihydroxy-6-methylbenzoate, phenoxyethyl bis-4-hydroxyphenyl acetate, 4,4'-diacetyldiphenylthiourea, 3-phenyl salicylic acid, 5-p-α-methylbenzyl-α-methylbenzyl salicylic acid, 5-p-methoxyphenoxy ethyl oxysalicylic acid, 5-phenoxyethoxy salicylic acid, 5-p-benzyl-α-methyl benzyl salicylic acid, 3-xylyl-5-(α,α-dimethylbenzyl)salicylic acid, 3,5-di-(α-methylbenzyl)salicylic acid or 2-hydroxy-1-α-ethylbenzyl-3-naphthoic acid, salicylic acid derivatives such as 3,5-dicyclopentadienyl salicylic acid and phenol resins such as para-phenyl phenol-formalin resin.

Further, a high-molecular weight compound having an alkoxysalicylic acid skeleton in side chains can also be used as an electron accepting compound. The electron accepting high-molecular weight compounds having an alkoxysalicylic acid skeleton in side chains are typified by those compounds which have ethers such as resorcinic acid and dihydroxynaphthalenecarboxylic acid in side chains. Among these compounds, those which are represented by the following formula (III) are preferred:

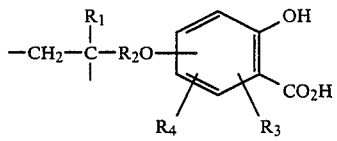

(III)

wherein $R_1$ is a hydrogen atom or an alkyl group, $R_2$ is a divalent group, $R_3$ and $R_4$ are each selected from the group consisting of a hydrogen atom, a halogen atom, a hydroxy group, an alkoxy group, an aryl group, an alkyl group, an aryloxy group, a thioalkoxy group, an alkoxycarbonyl group, an optionally substituted amino group, an acyloxy group, a cyano group, a nitro group, an acyl group, a carbamoyl group, a sulfamoyl group, an aralkyl group, a substituted aryl group, an alkyl group having a substituted aryl group, a carbonyl group, a carboxyl group, a sulfo group, etc., and $R_3$ and $R_4$ may combine together to form a 5- or 6-membered saturated or unsaturated ring such as a benzene ring, a pyridine ring or an anthraquinone ring.

In formula (II), $R_2$ is a group having not more than 16 carbon atoms and may be saturated or unsaturated, with the optional presence of an ether bond, an ester bond, a urethane bond or an amido bond. Preferred examples, of $R_2$ are $—C_xH_{2y}—$, —B—,

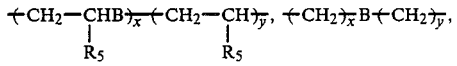

and $—B—C_xH_{2y}—$, wherein $R_5$ is the same as $R_3$ and may be exemplified by a hydrogen atom, a hydroxy group, an alkyl group, an acyloxy group, a halogen atom or an aryl group, B is selected from the group consisting of an oxygen atom, a sulfur atom, an arylene group, an alkenylene group, a branched alkylene group, a carbonyl group, —OCOO—, an amido group, etc., x and y are each an integer of 0 to 8. Particularly, preferred examples of $R_2$ are listed below:

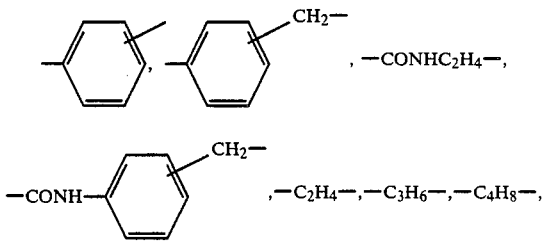

-continued $-C_8H_8-$, $-C_2H_4OC_2H_4-$, $-C_3H_6O-$, $-C_3H_5ClO-$, $-C_4H_6-$, $-C_3H_6(OH)O-$, $-C_3H_6OC_3H_6-$,

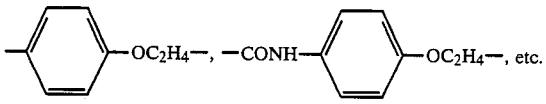

Preferred examples of $R_1$ are a hydrogen atom and a methyl group.

Specific and preferred examples of the alkoxysalicylic acid skeleton are listed below:

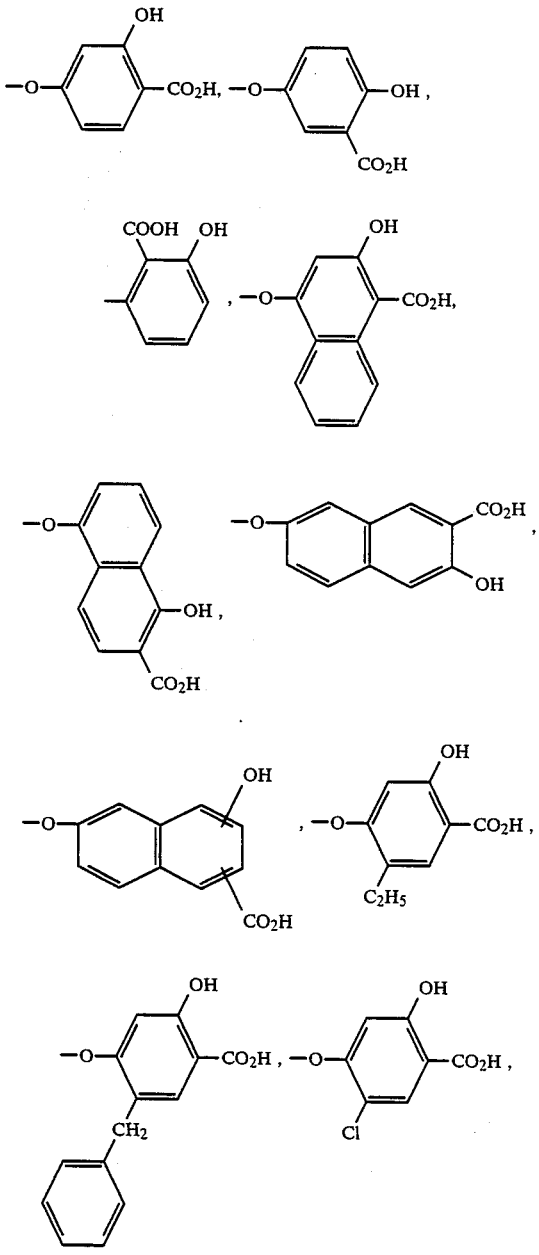

-continued

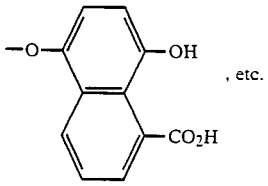

The above illustrated electron accepting high-molecular weight compounds having an alkoxysalicylic acid skeleton in side chains may be synthesized by such techniques as (1) vinyl polymerization and (2) high-molecular weight compound forming reaction.

Vinyl polymerization reaction is carried out by homopolymerizing or copolymerizing a compound of the following formula (IV).

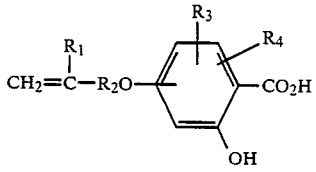

(IV)

Among the compounds represented by formula (IV), the compounds represented by the following formulae (V) and (VI) are preferred.

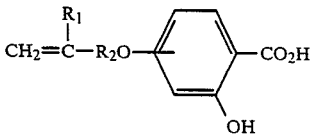

(V)

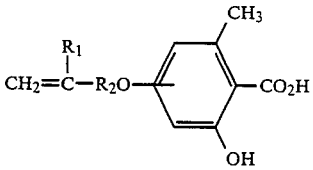

(VI)

Copolymerization reaction is a well known technique in the art and its details may be found in *Polymer Handbook*, John Wiley & Sons, Inc.

The compound of formula (IV) may be copolymerized with, for example, styrenes, (meth)acrylates or acrylamides. These compounds are used in such amounts that the content of the above-defined unit will be at least about 10%, preferably at least about 40%.

By proper selection of the monomer to be copolymerized with compound (IV), the resulting high-molecular weight compound can be controlled in terms of such aspects as particle size, solubility, stickiness, dispersion stability, and color forming ability.

Suitable examples of such monomers are listed below: acrylamide, cellosolve acrylate, styrene, methyl methacrylate, acrylonitrile, vinyl carbazole, octyl acrylate, sodium acrylamide propanesulfonate, butyl methacrylate, ethyl acrylate, divinylbenzene, vinyldioxolane, epichlorohydrin, allyl methacrylate, cinnamoyloxyethyl methacrylate, vinylbenzophenone, ethylene glycol acrylate, diethylene glycol diacrylate, and diethylene glycol acrylate butyrate.

Polymerization reaction may be carried out by a variety of techniques such as radical polymerization, ion polymerization, solution polymerization, emulsion polymerization, suspension polymerization and bulk polymerization.

Those organic developers are used, for example, with polyhydric metals such as zinc, magnesium, aluminum or calcium or with aliphatic carboxylic acids such as oxalic acid, maleic acid, sulfosuccinic acid or stearic acid, benzoic acid, p-tertiary amyl benzoic acid, phthalic acid or gallic acid.

When the compounds of formula (I) or (II) colorless dyes, and electron accepting compounds are used for recording materials, they are generally used in the form of a fine dispersion or fine droplets.

When used for a heat-sensitive paper, compounds represented by formula (I) or (II), electron donating colorless dyes and electron accepting compounds are pulverized and dispersed in a dispersion medium to the state of particles having a particle diameter of 10 μm or less, preferably 3 μm or less. A dispersion medium is generally an aqueous solution of a water-soluble high molecular weight compound having a concentration of from 0.25 to 10%. Upon dispersing, a ball mill, a sand mill, a horizontal sand mill attritor and a colloid mill are used. It is preferred that the compounds of formula (I) or (II) is added into a recording layer, a protective layer or an undercoat layer in the heat-sensitive paper.

The ratio of electron donating colorless dyes and electron accepting compounds to be used is generally from 1/10 to 1/0.1, and preferably from 1/5 to $\frac{2}{3}$. The additive ratio of the compounds of formula (I) or (II) to electron accepting compounds is preferably from 1/0.1 to 1/15. The compouonds of formula (I) or (II) are preferably used in an amount of 0.1 to 15 g/m$^2$, more preferably 0.5 to 3 g/m$^2$.

When the compounds of formula (I) or (II) are used, aromatic ether compounds such as aromatic alkyl or substituted alkyl ether as disclosed in Japanese Patent Application(OPI) No. 57989/83 may be used in combination. Examples of such ether compounds include phenoxyethyl biphenylether, phenethylbiphenyl, benzyloxynaphthalene, benzyl biphenyl, di-m-tolyloxyethane, bis-β-(p-methoxyphenoxy)ethylether, β-phenoxyethoxyanisole, 1-phenoxy-2-p-ethylphenoxyethane, bis-β-(p-methoxyphenoxy)ethoxymethane, 1-2′-methylphenoxy-2-4″-ethylphenoxyethane, 1-tolyloxy-2-p-methylphenoxyethane, 1,2-diphenoxyethane, 1,4-diphenoxybutane, bis-β-(p-ethoxyphenoxy)ethylether, 1-phenoxy-2-p-chlorophenoxyethane, 1,2′-methylphenoxy-2-4″-ethyloxyphenoxyethane, 1-4′-methylphenoxy-2-4″-fluorophenoxyethane, 1-phenoxy-2-p-naphthoxyphenylthioether, 1,2-bis-p-methoxyphenylthioether and 1-tolyloxy-2-p-methoxyphenylthioether. It is particularly preferred that higher fatty acid amide is used in combination.

Higher fatty acid amides are stearic acid derivatives, preferably amide and urea which are introduced from fatty acids having 16 to 18 carbon atoms such as amide, anilide, anisidide, methylenebis or stearylurea.

The above compounds are finely dispersed simultaneously with colorless electron donating dyes or electron accepting compounds. It is preferred in view of prevention of fog formation that the above compounds are dispersed simultaneously with colorless electron donating dyes. The additive amount thereof is preferably from 5 to 300 wt%, and more preferably from 10 to 150 wt%, based on the weight of electron accepting compounds.

In the present invention, it is preferred that pigments having a particle diameter of from 0.1 to 10 μm such as kaolin, calcined kaolin, talc, calcium carbonate, aluminum hydroxide, magnesium hydroxide, calcined gypsum, silica, magnesium carbonate, zinc oxide, alumina, barium carbonate, barium sulfate, mica, micro-balloons, urea and formaldehyde filler, polyethylene particles, cellulose filler and hindered phenol are used in combination. The preferred hindered phenols are phenol derivatives, at least one of 2- or 6-position of which is substituted with a branched alkyl group, such as 1,1-bis(2-methyl-4-hydroxy-s-t-butylphenyl)butane, 1,1,3-tris(3-methyl-4-hydroxy-5-t-butylphenyl)butane, bis(2-hydroxy-3-t-butyl-5-methylphenyl)methane, or bis(2-methyl-4-hydroxy-5-t-butylphenyl)sulfide.

Furthermore, various additives are added to a coating solution.

Examples of such additives include, for example, an oil absorbing substance such as polyurea filler which is dispersed in a binder to prevent head stain upon recording and a metal soap to increase the material's ability to separate from a thermal head. Accordingly, waxes, antistatic agents, ultraviolet absorbing agents, defoaming agents, electroconductive agents, fluorescent dyes and surface active agents are coated in addition to colorless electron donating dyes and electron accepting compounds which serve to form color and thus a recording material is prepared.

Examples of waxes include paraffin wax, carboxy modified paraffin wax, polyethylene wax, and higher fatty acid esters.

Examples of metal soaps include polyhydric metal salts of higher fatty acids, such as zinc stearate or zinc oleate.

The above additives are dispersed in a binder and coated. The binder is generally water soluble binders such as polyvinyl alcohol, hydroxyethyl cellulose, hydroxypropyl cellulose, epichlorohydrin modified polyamide, copolymer of ethylene and maleic anhydride, copolymer of styrene and maleic anhydride, copolymer of isobutylene and maleic anhydride, polyacrylic acid, polyacrylic acid amide, methylol modified polyacrylamide, starch derivatives, casein or gelatin. Further, for the purpose of imparting water-resistance to the binder, water-proofing agents (gelling agents and cross-linking agents) and emulsions of hydrophobic polymer such as styrene and butadiene rubber latex or acrylic resin emulsion can be added to the binders.

Furthermore, a layer of from 0.2 to 2 μm thickness comprised of water soluble high molecular weight compounds such as polyvinyl alcohol, hydroxyethyl starch or epoxy modified polyacrylamide and gelling agents (hardening agents) can be provided on the surface of a coated layer to provide chemical resistance.

The coating solution is generally coated on a transparent base film (e.g., polyethylene terephthalate base film), a neutral paper, a high grade paper or a synthetic paper, preferably a neutral paper coated with synthetic calcium carbonate.

The coating amount is generally from 2 to 10 g/m$^2$ by solid content.

A heat-sensitive paper can be various forms, as disclosed in German Patent (OLS) Nos. 2,228,581 and 2,110,854, and Japanese Patent Publication No. 20142/77. A heat-sensitive paper can be pre-heated, moisture-adjusted, or stretched prior to recording.

The present invention is illustrated in more detail by the following Examples, but is not limited thereto.

EXAMPLE 1

(1) Preparation of Sample No. 1

Each of 2 g of 2-anilino-3-methyl-6-N-ethyl-N-propylaminofluoran and 2 g of 2-anilino-3-chloro-6-diethylaminofluoran was dispersed with 25 g of a 3.5 wt% aqueous solution of polyvinyl alcohol (saponification degree: 99%, polymerization degree: 1000) using a sand mill, to prepare particles having an average particle diameter of 2 μm.

13 g of bisphenol A, 8 g of β'-p-methoxyphenoxyethyl-γ-methylbenzoylpropionate and 3 g of 1,2-bisphenoxyethane were dispersed with 50 g of a 3 wt% aqueous solution of polyvinyl alcohol using a ball mill for one day and one night. 0.1 g of 1,1,3-tris-2'-methyl-4'-hydroxy-5'-t-butylphenylbutane was dispersed with 20 g of 5 wt% aqueous solution of polyvinyl alcohol for one day and one night.

The above dispersions were mixed sufficiently and 20 g of Georgia kaolin and 6 g of silica fine particles were added thereto and dispersed and then 4.5 g of 50 wt% aqueous dispersion of paraffin wax emulsion (Cellozole #428 prepared by Chukyo Yushi KK.) was added thereto to prepare a coating solution.

The resulting coating solution was coated on a neutral paper having weighing capacity of 50 g/m$^2$ so that the coating amount by solid content was 5.2 g/m$^2$, dried at 60° C. for 1 min. and supercalendered at a linear pressure of 60 kg W/cm to obtain a coated paper.

The coated paper was heated to form color with heating energy of 35 mJ/mm$^2$ using a facsimile transmission machine, and the color densities were measured by a Macbeth reflective densitometer and found to be 0.90.

The thus obtained recording material had no fog formation before recording and had good stability with time passage. The thus obtained colored images were clearly black and had good resistances to chemicals and sunlight.

EXAMPLES 2 TO 5

The same procedures as in Example 1 were repeated to prepare a coating solution, except that β'-phenoxyethyl-γ-naphthoylpropionate, β'-phenoxypropyl-γ-naphthoylpropionate, β'-phenoxyethyl-β-naphthoxyacetate or Γ'-p-chlorophenoxyethyl-β-naphthoxyacetate, was used instead of β'-p-methoxyphenoxyethyl-γ-methylbenzoylpropionate. The thus obtained coating solution was coated on a high grade paper prepared by coating synthetic fine calcium carbonate (trade name "Brilliant 15") and carboxy modified SBR as a binder in an amount of 1.5 g/m$^2$ on a neutral paper.

Color was formed in the same manner as in Example 1 and thus clear black images were obtained and reflective densities were 0.8 or more.

These black images were clear and sharp. When these black images were brought into contact with oil and fat and were exposed to sunlight, they had excellent fade resistance and color change resistance.

EXAMPLE 6 AND COMPARATIVE EXAMPLE 1

The same procedures as in Example 1 were repeated to prepare a recording material, except that 11 g of β'-p-chlorophenoxyethyl-β-naphthoxyacetate (Example 6) or 11 g of 1,2-bis-phenoxyethane (Comparative Example 1) was used instead of 8 g of β'-p-methoxyphenoxyethyl-γ-methylbenzoylpropionate and 3 g of 1,2-bis-phenoxyethane.

The thus obtained recording materials were evaluated for a heat stability by measuring a temperature at which color was formed using a heat stamp.

As a result, the recording material according to the present invention (Example 6) started to form color at 91° C., whereas the comparative recording material (Comparative Example 1) setarted to form color at 79° C.

From the comparative results, it can be seen that the recording material according to the present invention has excellent stability at a high temperature.

While the invention has been described in detail and with reference to specific embodiments thereof, it will be apparent to one skilled in the art that various changes and modifications can be made therein without departing from the spirit and scope thereof.

What is claimed is:

1. A recording material capable of color formation by contact of a colorless electron donating dye with an electron accepting compound, comprising: a support having thereon a coating, said coating containing a colorless electron donating dye, an electron accepting compound and a compound represented by formula (I) or (II)

$$Ar_1XC_nH_{2n}YC_mH_{2m}ZAr_2 \quad (I)$$

wherein $AR_1$ and $Ar_2$ each represents an aromatic ring which may contain an oxygen atom or sulfur atom: Z represents a divalent group selected from the group consisting of —CO— and —O—; X represents a divalent group selected from the group consisting of —O— and —S—, and Y represents a divalent group selected from the group consisting of —O—, —S— and $CO_2$—, provided that Z is —CO—, or X represents a divalent group of —O— and Y represents a divalent group selected from the group consisting of —$CO_2$—, —$SO_2$— and —SO—, provided that Z is —O—; and n and m each represents an integer of from 1 to 6, $$Ar_1XC_nH_{2n}YC_mH_{2m}YC_nH_{2n}XAr_2 \quad (II)$$

wherein $Ar_1$ and $Ar_2$ each represents an aromatic ring which may contain an oxygen atom or a sulfur atom; X represents a divalent group selected from the group consisting of —S— and —O—; Y represents a divalent group of —$CO_2$—; and n and m each represents an integer of from 1 to 6.

2. A recording material as in claim 1, wherein said compound represented by formula (I) or (II) has a melting point of from 70° to 190° C. and contains 16 to 28 carbon atoms.

3. A recording material as in claim 1, wherein said compound represented by formula (I) or (II) has a melting point of from 85° to 130° C. and contains 16 to 26 carbon atoms.

4. A recording material as in claim 1, wherein the ratio of compound represented by formula (I) or (II) to electron accepting compound is from 1/0.1 to 1/15.

5. A recording material as in claim 1, wherein said recording material additionally contains at least one aromatic ether compound.

6. A recording material as in claim 1, wherein said recording material additionally contains a higher fatty acid amide additive in an amount of not more than 300 wt% based on the weight of electron accepting compound.

7. A recording material as in claim 6, wherein said recording material additionally contains a higher fatty acid amide additive in an amount of from 10 to 150 wt% based on the weight of electron accepting compound.

8. A recording material as in claim 1, wherein said recording material comprises a recording layer containing said electron donating dye, said electron accepting compound and said compound represented by formula (I) or (II), coated in an amount of from 2 to 10 g/m$^2$ (solid content).

9. A recording material as in claim 1, wherein said recording material is heat-sensitive.

10. A recording material as in claim 1, wherein X is —O—.

* * * * *